US007867646B2

(12) United States Patent
Rhodes

(10) Patent No.: US 7,867,646 B2
(45) Date of Patent: Jan. 11, 2011

(54) THERMOSTAT WITH OPENING PORTION FOR ACCESSING BATTERIES FIELD

(75) Inventor: William D. Rhodes, Red Bud, IL (US)

(73) Assignee: Emerson Electric, Co., St. Louis, MO (US)

( * ) Notice: Subject to any disclaimer, the term of this patent is extended or adjusted under 35 U.S.C. 154(b) by 1022 days.

(21) Appl. No.: 11/657,931

(22) Filed: Jan. 25, 2007

(65) Prior Publication Data

US 2008/0179412 A1 Jul. 31, 2008

(51) Int. Cl.
*H01M 2/10* (2006.01)
*G05D 23/00* (2006.01)

(52) U.S. Cl. ..... 429/100; 236/1 C; 361/600; 429/96; 429/97; 429/99; 429/9

(58) Field of Classification Search ..... 429/9, 429/96, 97, 99, 100; 236/1 C; 361/600; 292/147

See application file for complete search history.

(56) References Cited

U.S. PATENT DOCUMENTS 5,372,395 A * 12/1994 Yang ..... 292/147
5,637,417 A 6/1997 Engmark et al. ..... 429/97
5,654,870 A 8/1997 Havener ..... 361/600
5,931,513 A * 8/1999 Conti ..... 292/87
6,093,056 A 7/2000 Donauer et al. ..... 439/500
6,117,575 A 9/2000 Dinsdale ..... 429/1
6,225,777 B1 5/2001 Garcia et al. ..... 320/112
6,409,042 B1 * 6/2002 Hirano et al. ..... 220/812
6,806,681 B1 10/2004 Cheiky ..... 320/107
7,438,469 B1 * 10/2008 Moore ..... 374/209
2006/0172182 A1 * 8/2006 Barton et al. ..... 429/96

OTHER PUBLICATIONS

"Detent." Merriam-Webster Online Dictionary. 2010. http://www.merriam-webster.com (Aug. 24, 2010).*

* cited by examiner

*Primary Examiner*—Dah-Wei D Yuan
*Assistant Examiner*—Edu E Enin-Okut
(74) *Attorney, Agent, or Firm*—Harness, Dickey & Pierce, P.L.C.

(57) ABSTRACT

A thermostat is provided with a closure member that encloses at least one battery received within the thermostat housing. The thermostat includes a thermostat housing having at least one compartment in the housing adapted to receive at least one battery therein, and a retaining portion. The thermostat further includes a closure member pivotally secured to the thermostat housing, which is slidable relative to the thermostat housing between an open position in which the closure member freely pivots relative to the housing to permit access to the at least one compartment for replacement of a battery therein, and a latched position in which a latching portion on the closure member slidably engages the retaining portion on the thermostat housing to secure the closure member in a latched position.

7 Claims, 4 Drawing Sheets

THERMOSTAT WITH OPENING PORTION FOR ACCESSING BATTERIES FIELD

FIELD

The present disclosure relates to digital thermostats including one or more batteries, and more specifically to battery enclosures for digital thermostats.

BACKGROUND

The statements in this section merely provide background information related to the present disclosure and may not constitute prior art.

Many digital thermostats utilize battery power as either a source for powering the thermostat or as a back-up power source for retaining stored parameters in the event of a power interruption. Accordingly, one or more batteries are often mounted within the thermostat, which must periodically be replaced. To replace the batteries, many digital thermostats require dismantling or removal of the thermostat from a support base, which can be tedious and difficult to reinstall. Moreover, accidental damage to the thermostat can occur if the thermostat is dropped during removal or misaligned during reinstallation.

SUMMARY

In one aspect of the present invention, various embodiments of a thermostat are provided with a closure member that encloses at least one battery received within the thermostat housing. In the various embodiments, the thermostat includes a thermostat housing having at least one compartment in the housing adapted to receive at least one battery therein, and a retaining portion. The thermostat further includes a closure member pivotally secured to the thermostat housing, which is slidable relative to the thermostat housing between an open position in which the closure member freely pivots relative to the housing to permit access to the at least one compartment for replacement of a battery therein, and a latched position in which a latching portion on the closure member slidably engages the retaining portion on the thermostat housing to secure the closure member in a latched position.

In another aspect of the invention, the various embodiments of a thermostat further include at least one battery that is received within the at least one compartment and biased by a spring towards the closure member. The closure member is positioned relative to the at least one compartment such that the distance between the axial centerline of the at least one battery and the pivot axis about which the closure member pivots is approximately equal to the radius of the at least one battery, such that when the closure member is in an unlatched position, the spring causes the at least one battery to force the closure member open and to protrude at least partially out of the compartment in a manner that holds the closure member in an open position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
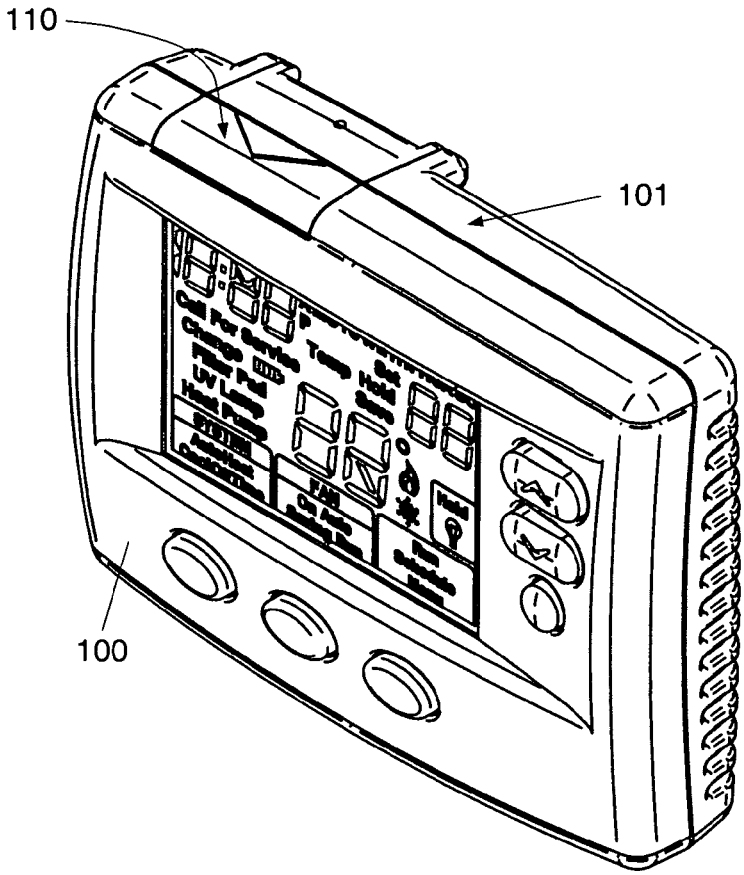
FIG. 1 shows a perspective view one embodiment of a thermostat having a closure member in a latched position.

The following description is merely exemplary in nature and is not intended to limit the present disclosure, application, or uses. It should be understood that throughout the drawings, corresponding reference numerals indicate like or corresponding parts and features.

In the various embodiments, a thermostat housing and closure component are provided that are capable of enclosing and retaining one or more batteries for powering the thermostat. It should be noted that the thermostat may be adapted to control the operation of an air conditioner or a heating unit, such as a furnace or water heater appliance, and may be adapted to be powered by either a hard-wired connection to an external power source or by the one or more batteries retained within the thermostat. In one first embodiment of a thermostat shown in FIGS. 1 and 2, the thermostat comprises a thermostat housing 100 having a door or closure member 110 that is secured to the top side 101 of the thermostat housing 100 for enclosing one or more batteries B received within the housing 100. The door or closure member 110 is positioned on the top side of the thermostat housing 100 where the door and battery compartment beneath the door are more readily illuminated and clearly visible to a user.

Figure 3:
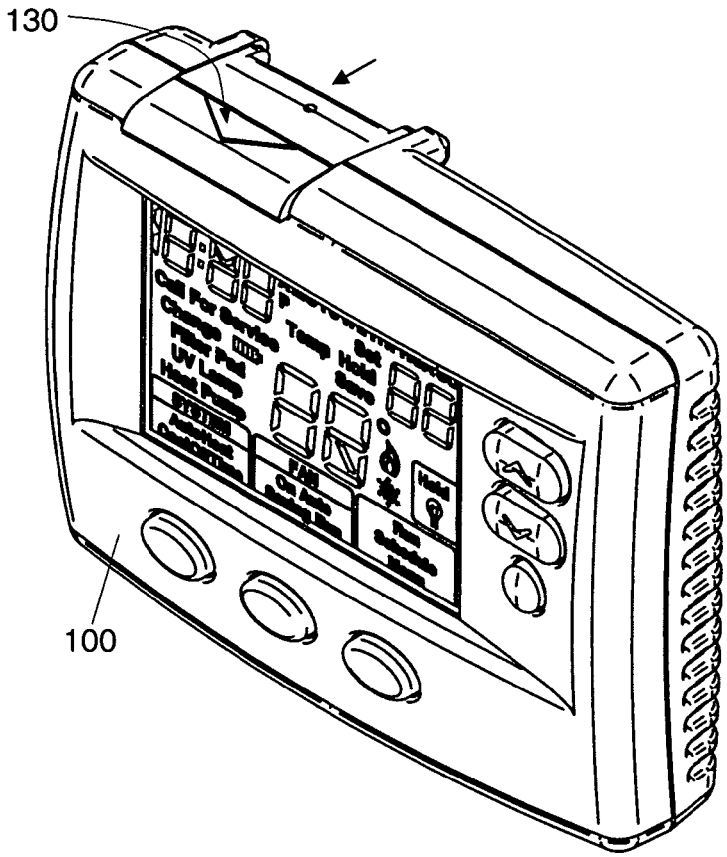
FIG. 3 shows a perspective view one embodiment of a thermostat having a closure member in an unlatched position.
Figure 4:
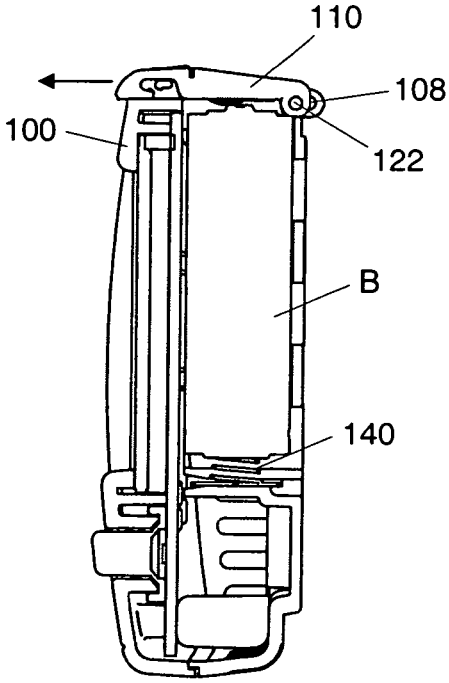
FIG. 4 is a side cross-section view of the thermostat in FIG. 3 showing the closure member in an unlatched position.

As shown in FIGS. 3 and 4, the closure member 110 is slidable relative to the thermostat housing 100, to permit the closure member 110 to be moved to an unlatched position to gain access to one or more batteries received within the thermostat housing. The outer surface of the closure member 110 preferably includes an arrow 130 pointing outward or away from the thermostat housing 100, which arrow indicates the direction in which the closure member 110 is to be moved to be unlatched. Preferably, the closure member 110 is pressed downward and moved towards the front of the thermostat housing 100 in the direction indicated by the arrow, until the closure member 110 is unlatched. Once the closure member is unlatched, the closure member 110 will begin to open due to a biasing force exerted against the battery that pushes the battery in an upward direction against the closure member 110.

Figure 5:
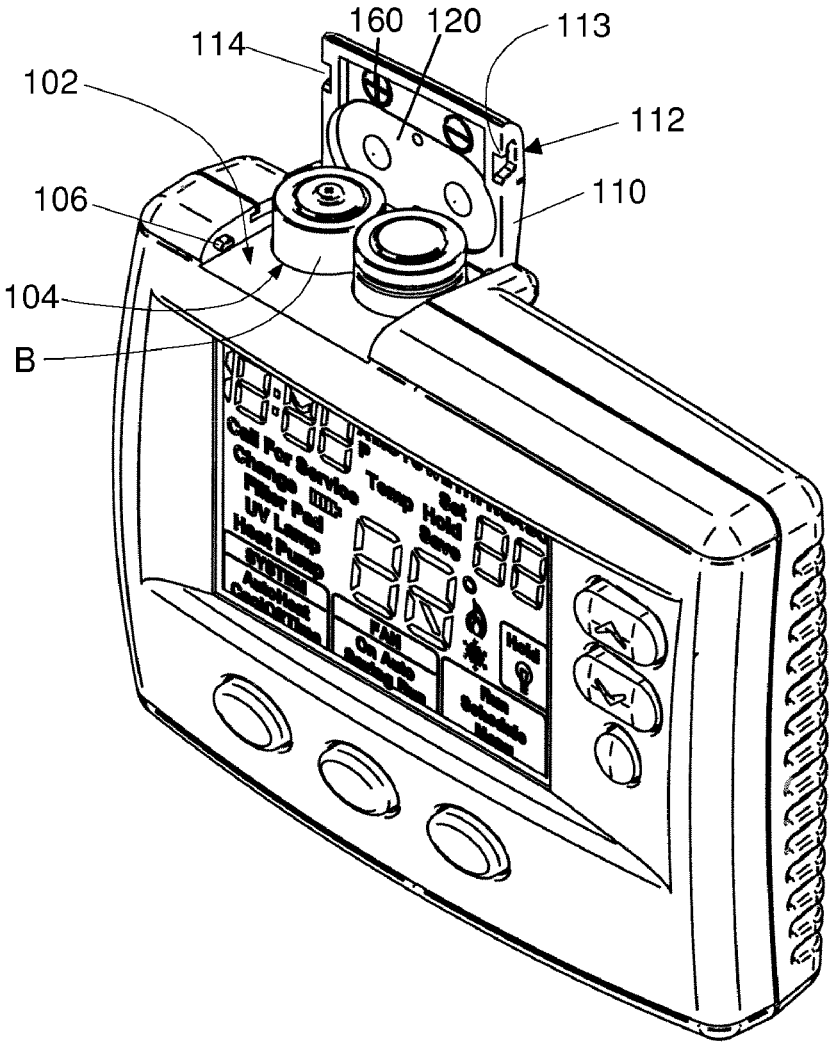
FIG. 5 shows a perspective view one embodiment of a thermostat having a closure member pivoted to an open position.
Figure 6:
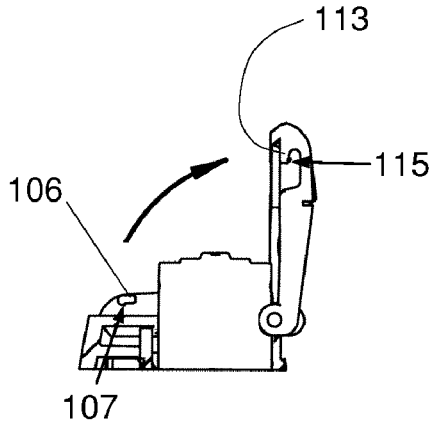
FIG. 6 is a side cross-section view of the thermostat in FIG. 5 showing the closure member pivoted to an open position.

Referring to FIGS. 5 and 6, the closure member 110 of the first embodiment is further pivotally coupled to the thermostat housing 100, to permit the closure member 110 to be pivoted for accessing one or more batteries B. Specifically, the thermostat housing 100 has a recessed portion 102 and at least one compartment 104 within the housing 100 that is adapted to receive at least one battery B therein. It should be noted that the thermostat housing 100 may alternately have two individual compartments rather than one compartment, and may comprise any number of compartments to accommodate any number of batteries to be received within the thermostat housing. In the first embodiment, the thermostat housing 100 further includes at least one retaining portion 106 on the housing 100, and at least one slotted portion 108 adapted to slidably receive a pivot pin of the closure member therein. The at least one retaining portion 106 may comprise a retaining member that projects outwardly from the housing 100, which retaining member 106 is adapted to slidably engage a portion on the closure member 110 to secure the closure member 110 in a closed position.

In the first embodiment, the closure member 110 has at least one pivot pin 122 slidably disposed within a slotted portion 108 in the thermostat housing 100. The thermostat housing 100 preferably includes at least one slotted portion 108 in which a pivot pin 122 on the closure member 100 is slidably received, which slotted portion 108 permits the pivot pin and closure member 110 to slidably move relative to the thermostat housing 100. Accordingly, the closure member 110 is configured for both sliding and pivotal movement relative to the at least one slotted portion 108 of the thermostat housing 100.

In the first embodiment, the closure member 110 is slidable between a first position shown in FIG. 5 in which the closure member 110 is pivotal about its at least one pivot pin 122 to an open position that allows access to the at least one compartment 104 for removal or insertion of at least one battery B therein. The closure member 110 is also slidable to a latched position (as shown in FIG. 1) in which at least one latching portion 112 on the closure member 110 slidably engages the retaining portion or member 106 to secure the closure member 110 in a closed position relative to the housing 100. In the first embodiment, the latching portion 112 comprises a recess 114, and a catch member 113 that is received below and engages the at least one retaining member 106 on the thermostat housing 100 when the closure member 110 is positioned flush against the thermostat housing 100 and slidably moved towards a latched position. The catch member 113 preferably frictionally engages the retaining member 106. More preferably, the catch member 113 and the retaining member 106 may both include a detented or cam-shaped configuration, where movement of the closure member 110 to the closed position requires the detent 115 or cam-shaped portion on the catch member 113 to slide past a point of frictional engagement with the detent 107 on the retaining member 106 before reaching a fully closed or latched position. In this manner, the frictional engagement between the retaining portion 106 and the latching portion 112 or catch member 113 inhibits movement of the closure member 110 away from the closed position.

In the first embodiment, the closure member 110 further includes at least one electrically conductive contact member 120 disposed on a side of the closure member 110 facing the at least one compartment 104 in the thermostat housing 100. The at least one electrically conductive contact member 120 is adapted to establish electrical contact with at least one battery B that is received within the at least one compartment 104 when the closure member 110 is slidably moved to a latched position (as shown in FIG. 1).

Figure 2:
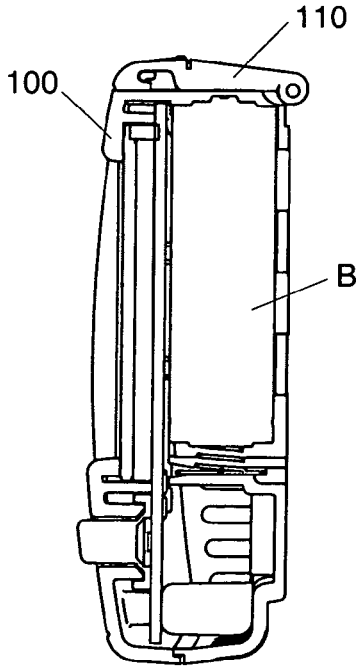
FIG. 2 is a side cross-section view of the thermostat in FIG. 1 showing the closure member in a latched position.

In the first embodiment, the closure member 110 includes at least one recessed area 114 in which at the least one retaining member 106 projecting from the thermostat housing 100 is received when the closure member 110 is pivoted to a position flush against the thermostat housing (as shown in FIG. 4). The at least one latching portion 112 preferably comprises at least one catch 114 that is received below the at least one retaining member 106 when the closure member is positioned flush against the thermostat housing and slidably moved towards a latched position (as shown in FIG. 2). In this closed position shown in FIG. 2, the latching portion 112 on the closure member 110 preferably frictionally engages the retaining member 106 on the thermostat housing 100. Additionally, the closure member 110 includes an outer surface that is flush with the outer surface of the thermostat housing 100 when the closure member is slidably moved to the closed position, as shown in FIG. 1.

Referring to FIG. 6, the first embodiment of a thermostat further includes at least one battery B that is received within the at least one compartment 104, and is biased by a spring 140 upwards towards the closure member 110. The distance D between the axial centerline of the at least one battery B and the pivot pin or axis about which the closure member 110 pivots is approximately equal to the radius of the at least one battery. The pivot axis of the closure member 110 is positioned at this approximate distance such that when the closure member is moved to an unlatched position (as shown in FIG. 4), the spring 140 causes the at least one battery B to move upward and force the closure member 110 to pivot open. The spring 140 causes the at least one battery B to further move upward, to protrude at least partially out of the at least one compartment 104 in a manner such that the closure member 110 is held in an open position by at least one battery B that is partially protruding out of the compartment 104, as shown in FIG. 6. It should be noted that the compartment 104 and the spring for biasing the at least one battery B are sized such that the battery B will at least partially protrude out of the compartment 104. Accordingly, the closure member or door 110 is conveniently held in an open position, without the need for any torsion spring or other device for biasing the closure member to pivot towards an open position. The user may then easily remove the at least one battery by hand, since the at least one battery B is partially protruding from and extending out of the compartment 104 in the housing 100.

For battery replacement purposes, the closure member 110 of the first embodiment includes one or more polarity markings 160 on the inner surface of the closure member 110, which provide an indication of the required orientation that the at least one battery is to be inserted into the compartment 104. After installing the at least one battery B therein, the user may press the closure member 110 down completely flush against the thermostat housing 100 to compress the spring biasing the battery, and push the closure member towards the back of the thermostat to slidably move the closure member into a latched position. Thus, because the at least one battery B is accessible from the top of the thermostat housing 100, the user does not need to dismantle or remove the thermostat from a mounting base to replace the batteries.

Figure 7:
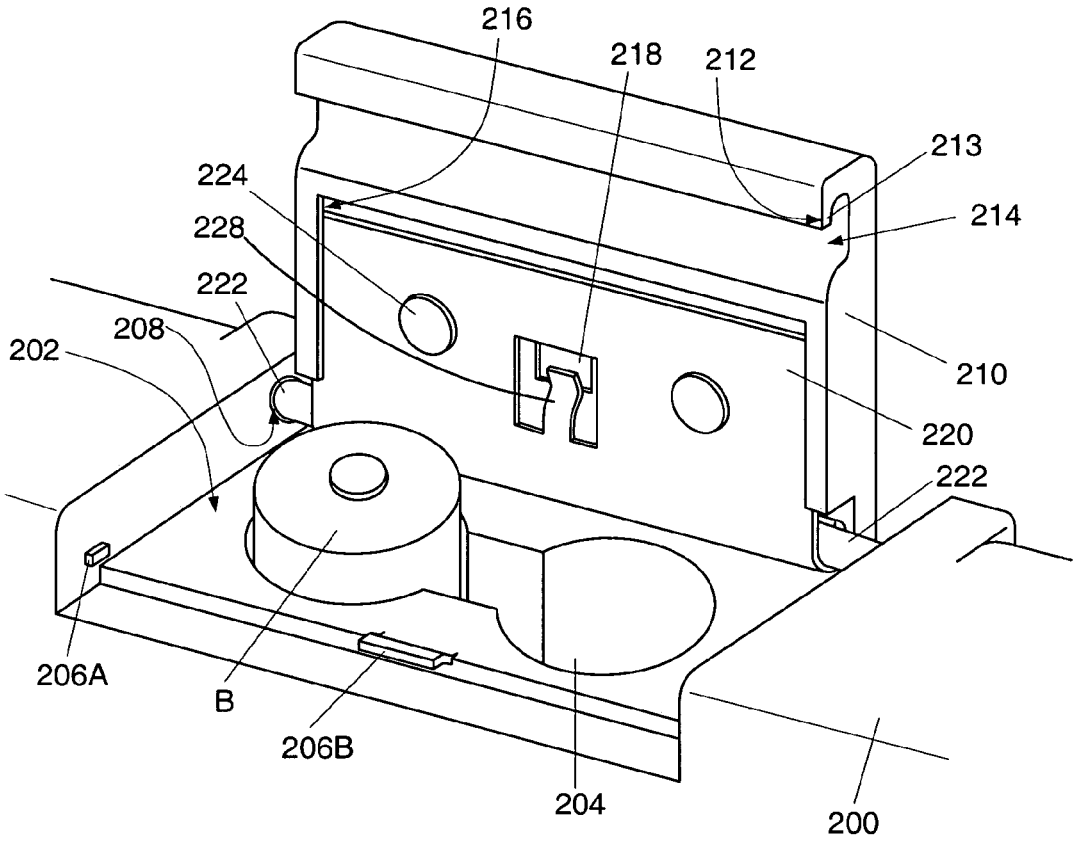
FIG. 7 shows a second embodiment of a thermostat housing and closure member, in which the closure member is pivoted to an open position.

In a second embodiment shown in FIG. 7, a door or closure member 210 is similarly pivotally coupled to the top side of the thermostat housing 200, to permit the closure member 210 to be pivoted open for accessing one or more batteries B received within the thermostat housing 200. The door or closure member 210 is positioned on the top side of the thermostat housing 200 where the door and battery compartment beneath the door are more readily illuminated and clearly visible to a user.

The closure member 210 is further slidable relative to the thermostat housing 200, to permit the closure member 210 to be unlatched to gain access to one or more batteries received within the thermostat housing. The outer surface of the closure member 210 may further include an arrow (not shown) pointing outward or away from the thermostat housing 200, which arrow indicates the direction in which the closure member 210 is to be moved to be unlatched. Preferably, the closure member 210 is pressed downward and moved towards the front of the thermostat housing 200, until the closure member 210 is unlatched. Once the closure member is unlatched, the closure member 210 will begin to open due to a biasing force exerted against the battery B that pushes the battery in an upward direction against the closure member 210.

The thermostat housing has a recessed area 202 that includes at least one compartment 204 therein adapted to receive at least one battery, and also includes at least one retaining portion, shown as 206A and/or 206B. It should be noted that the thermostat housing 200 may include only a single retaining member 206B, or one or more retaining portions such as 206A or a combination of any number of retaining portions 206 suitable for engaging the latching portion 212 of the closure member 210.

The second embodiment comprises a closure member 210 has an electrically conductive contact member 220 disposed thereon, which is pivotally secured to the housing 200 to allow the closure member to close off the at least one recessed area 202 and at least one compartment 204. The closure member 210 is slidable relative to the housing 200 between an open position shown in FIG. 7 and a closed position (similar to that shown in FIG. 1). In the open position shown in FIG. 7, the closure member 210 freely pivots relative to the housing 200 to permit access to the at least one compartment 204 for removal or insertion of a battery therein. In the latched position, the at least one latching portion 212 on the closure member 210 slidably engages the at least one retaining portion 206A and/or 206B on the thermostat housing 200, to secure the closure member 210 in a latched position relative to the thermostat housing 200.

In the second embodiment, the closure member 210 is pivotally secured to the thermostat housing 200 by an electrically conductive contact member 220 that includes a pivot pin thereon 222 received within a slot 208 within the housing 200. The closure member 210 preferably includes one or more slots 216 in which the electrically conductive contact member 220 is slidably received, such that the closure member 210 and its latching portion 212 are slidable relative to the electrically conductive contact member 220. This allows the closure member 210 and its latching portion 212 to slidably move relative to the thermostat housing 200, such that the latching portion 212 may slidably engage and disengage with the at least one retaining portion 206A and/or 206B on the thermostat housing.

In the second embodiment shown in FIG. 7, the at least one latching portion 212 on the closure member 210 comprises a recess 214 in which at least one retaining portion 206A and/or 206B that projects from the thermostat housing 200 is received. Accordingly, a retaining portion 206 on the thermostat housing 200 is received within the closure member's recess 214 when the closure member is pivoted to a position flush against the thermostat housing 200, and slidably moved towards a latched position. Alternatively, the thermostat housing's retaining portion 212 may comprise a recessed cavity in the housing (in place of the protruding member 214), and the at least one latching portion 212 may comprise a catch 213 protruding from the closure member 210 that is suitably received within the recessed retaining portion.

Referring to FIG. 7, the closure member 210 is slidably movable relative to the electrically conductive contact member 220, which includes a spring member 228 biased against the closure member 210 that is slidably received within a depression 218 in the closure member 210 when the closure member 210 is moved to a closed or latched position. In this manner, the closure member 210 is maintained in a closed position by frictional engagement between the spring member 228 received within the depression 21. Accordingly, the frictional resistance must be overcome to slidably move the closure member 210 towards an unlatched position in which the closure member 210 may freely pivot open as shown in FIG. 7 to gain access to the one or more compartments 204.

Similar to the first embodiment, the second embodiment also has a closure member 210 that includes at least one recessed area 214 in which at least one retaining portion 206 projecting from the thermostat housing 200 is received when the closure member 210 is pivoted to a position flush against the thermostat housing 200. The closure member's at least one latching portion 212 similarly comprises a catch 213 protruding from the closure member 210 that is received below at least one retaining member 206A and/or 206B when the closure member 210 is positioned flush against the thermostat housing 200 and slidably moved towards a closed position. The latching portion 212 on the closure member 210 may further be configured to frictionally engage at least one retaining portion 206A and/or 206B on the thermostat housing 200 when the closure member 210 is slidably moved to the latched position, for securing the closure member 210 to inhibit pivotal movement of the closure member 210 relative to the thermostat housing 200. In the latched position, the at least one electrically conductive contact member 220 is adapted to establish electrical contact with at least one battery (not shown) that is received within the at least one compartment 204.

The second embodiment of a thermostat further includes at least one battery B that is received within the at least one compartment 204, and is biased by a spring (not shown) upwards towards the closure member 210. The distance between the axial centerline of the at least one battery B and the pivot pin or axis about which the closure member 210 pivots is approximately equal to the radius of the at least one battery, such that when the closure member 210 is moved to an unlatched position, the spring biasing the battery B causes the at least one battery B to move upward and force the closure member 210 to pivot open as shown in FIG. 7. The spring causes the at least one battery B to further move upward, to protrude at least partially out of the at least one compartment 204 in a manner such that the closure member 210 is held in an open position by at least one battery B that is partially protruding out of the compartment 204. It should be noted that the compartment 204 and the spring for biasing the at least one battery B are sized such that the battery B will at least partially protrude out of the compartment 204. Accordingly, the closure member or door 210 is conveniently held in an open position, without the need for any torsion spring or other device for biasing the closure member to pivot towards an open position. The user may then easily remove the at least one battery by hand, since the at least one battery B is partially protruding from and extending out of the compartment 204 in the housing 200.

For battery replacement purposes, the closure member 210 of the first embodiment includes one or more polarity markings on the inner surface of the closure member 210, which provide an indication of the required orientation that the at least one battery is to be inserted into the compartment 204. After installing the at least one battery B therein, the user may press the closure member 210 down completely flush against the thermostat housing 200 to compress the spring biasing the battery, and push the closure member towards the back of the thermostat to slidably move the closure member into a latched position. Because the at least one battery B is accessible from the top of the thermostat housing 200, the user does not need to dismantle or remove the thermostat from a mounting base to replace the batteries.

The advantages of the above described embodiment and improvements should be readily apparent to one skilled in the art, as to enabling the enclosure and retention of at least one battery within a thermostat housing. Additional design considerations may be incorporated without departing from the spirit and scope of the invention. Accordingly, it is not intended that the invention be limited by the particular embodiment or form described above, but by the appended claims.

What is claimed is:

1. A thermostat comprising:

a thermostat housing having at least one compartment in the housing adapted to receive at least one battery therein, at least one slotted portion adapted to slidably receive a pivot pin therein, and at least one retaining member projecting from the housing;

a closure member having at least one pivot pin slidably disposed within the slotted portion in the housing, the closure member being slidable between a first unlatched position in which the closure member is pivotal about its at least one pivot pin to an open position that allows access to the at least one compartment for removal or insertion of a battery therein, and a latched position in which the at least one latching portion on the closure member is received below and engages the at least one retaining member on the thermostat housing, to retain the closure member in a latched position;

a spring within the at least one compartment, for biasing at least one battery that is received within the compartment towards the closure member;

at least one battery that is received within the at least one compartment; and at least one electrically conductive contact member disposed on a side of the closure member facing the at least one compartment in the thermostat housing, wherein the at least one electrically conductive contact member establishes electrical contact with at least one battery that is received within the at least one compartment when the closure member is slidably moved to a latched position, wherein when the closure member is in the first unlatched position, the distance between the axial centerline of the at least one battery and the pivot axis about which the closure member pivots is approximately equal to the radius of the at least one battery, such that the closure member is held in a fully open position by contact between the closure member and the at least one battery when the closure member is in the first unlatched position and the spring causes the at least one battery to force the closure member open and to protrude at least partially out of the compartment.

2. The thermostat of claim 1 wherein the slotted portion in the thermostat housing extends towards the front of the thermostat housing such that the closure member having a pivot pin disposed within the slotted portion is both movable towards the front of the thermostat housing to an unlatched position, and also movable towards the back of the thermostat to a latched position, to thereby permit the latching portion to engage and disengage the retaining member on the thermostat housing.

3. The thermostat of claim 2 wherein the pivot pin disposed within the slotted portion is slidable in a direction towards the front of the thermostat housing, such that the closure member and at least one pivot pin are slidable towards the first position in which the latching portion on the closure member disengages the at least one retaining member on the thermostat, and the closure member is pivotal to an open position that allows access to the at least one compartment.

4. The thermostat of claim 3 wherein the latching portion on the closure member frictionally engages the retaining member on the thermostat housing when the closure member is slidably moved to the latched position.

5. The thermostat of claim 3, wherein the catch comprises a detent portion, and the at least one retaining member includes a detent portion, where movement of the closure member to the latched position causes the detent portion on the catch to slide past a point of frictional engagement with the detent portion on the retaining member.

6. The thermostat of claim 2 wherein the closure member includes an outer surface that is flush with the outer surface of the thermostat housing when the closure member is slidably moved to the latched position.

7. The thermostat of claim 6 wherein the closure member further includes one or more polarity markings on the inner surface of the closure member, which provide an indication of the required orientation for inserting at least one battery into the compartment.

* * * * *

UNITED STATES PATENT AND TRADEMARK OFFICE

CERTIFICATE OF CORRECTION

PATENT NO. : 7,867,646 B2
APPLICATION NO. : 11/657931
DATED : January 11, 2011
INVENTOR(S) : William D. Rhodes It is certified that error appears in the above-identified patent and that said Letters Patent is hereby corrected as shown below:

Title Page, Item [54] Title

Delete "FIELD"

Signed and Sealed this
Fifteenth Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,867,646 B2
APPLICATION NO. : 11/657931
DATED : January 11, 2011
INVENTOR(S) : William D. Rhodes It is certified that error appears in the above-identified patent and that said Letters Patent is hereby corrected as shown below:

Title Page, Item [54] and at column 1, line 2, Title

Delete "FIELD"

This certificate supersedes the Certificate of Correction issued March 15, 2011.

Signed and Sealed this
Twenty-sixth Day of April, 2011

David J. Kappos

David J. Kappos
*Director of the United States Patent and Trademark Office*